US010326189B2

(12) United States Patent
Nezakati et al.

(10) Patent No.: US 10,326,189 B2
(45) Date of Patent: Jun. 18, 2019

(54) ORTHO-MODE TRANSDUCER AND DIPLEXER

(71) Applicant: Google Inc., Mountain View, CA (US)

(72) Inventors: Toktam Nezakati, Sausalito, CA (US); Farbod Tabatabai, Sausalito, CA (US); Siyuan Xin, Los Altos, CA (US); Benjamin K. Yaffe, San Francisco, CA (US); Keith Thomas Williams, Phoenix, AZ (US); Eduardo Tinoco, Surprise, AZ (US); Jose Alex Rivas, Sunnyvale, CA (US)

(73) Assignee: Google LLC, Mountain View, CA (US)

( * ) Notice: Subject to any disclaimer, the term of this patent is extended or adjusted under 35 U.S.C. 154(b) by 4 days.

(21) Appl. No.: 15/497,061

(22) Filed: Apr. 25, 2017

(65) Prior Publication Data

US 2018/0309180 A1 Oct. 25, 2018

(51) Int. Cl.
*H01P 1/17* (2006.01)
*H01P 1/161* (2006.01)

(52) U.S. Cl.
CPC ..... *H01P 1/161* (2013.01); *H01P 1/171* (2013.01)

(58) Field of Classification Search
CPC ..... H01P 1/2131; H01P 1/161; H01P 1/165; H01P 1/17; H01P 5/12
See application file for complete search history.

(56) References Cited

U.S. PATENT DOCUMENTS 3,958,192 A * 5/1976 Rootsey ..... H01P 5/12 333/125
7,474,173 B2 1/2009 Avramis et al.
8,022,788 B2 * 9/2011 Sarasa ..... H01P 1/209 333/135
8,665,037 B2 3/2014 Nicotra
9,490,862 B2 11/2016 Brown et al.

FOREIGN PATENT DOCUMENTS

CN 104681898 A 6/2015

* cited by examiner

*Primary Examiner* — Robert J Pascal
*Assistant Examiner* — Kimberly E Glenn
(74) *Attorney, Agent, or Firm* — Honigman LLP

(57) ABSTRACT

A method includes receiving, through a vertical polarization port of an orthogonal-mode transducer (OMT), a vertical polarized signal from a vertical polarization diplexer, and receiving, through a horizontal polarization port of the OMT, a horizontal polarized signal from a horizontal polarization diplexer. The method also includes receiving, through a common port of the OMT, a circular polarized signal comprising the vertical and horizontal polarized signals. The common waveguide includes a septum polarizer configured to split or combine between the circular polarized signal, and the vertical polarized signal and the horizontal polarized signal.

18 Claims, 9 Drawing Sheets

ORTHO-MODE TRANSDUCER AND DIPLEXER

TECHNICAL FIELD

This disclosure relates to integrated orthogonal-mode transducers and diplexers.

BACKGROUND

Radio links are widely used for wireless communications between mobile phones and base stations within a communication network. The use of two radio links both operating at a same frequency, but with cross-polarization, can double output capacity of the radio links. To achieve cross polarization, an antenna is coupled to two radios (transmitter and receiver), with one radio transmitting and receiving with a vertical polarization and the other radio transmitting and receiving with a horizontal polarization, and employing an orthogonal-mode transducer to separate the vertically polarized signals from the horizontally polarized signals.

SUMMARY

Implementing cross polarization at higher bandwidths including the E-band extending between 60 Gigahertz to 80 Gigahertz becomes challenging due to frequency mismatches between the orthogonal-mode transducer and the radios. The present disclosure describes an integrated orthogonal-mode transducer and diplexers that accommodate cross polarization at various bandwidths, inter alia.

One aspect of the disclosure provides a method for splitting or combining between a circular polarized signal and vertical and horizontal polarized signals. The method includes receiving, through a vertical polarization port of an orthogonal-mode transducer, a vertical polarized signal from a vertical polarization diplexer and receiving, through a horizontal polarization port of the orthogonal-mode transducer, a horizontal polarized signal from a horizontal polarization diplexer. The method also includes receiving, through a common port of the orthogonal-mode transducer, a circular polarized signal comprising the vertical polarized signal and the horizontal polarized signal and receiving, through a common waveguide connected to the common port and in communication with the vertical polarization port and the horizontal polarization port, the circular polarized signal. The common waveguide includes a septum polarizer configured to split or combine between the circular polarized signal and the vertical polarized signal and the horizontal polarized signal.

Implementations of the disclosure may include one or more of the following optional features. In some implementations, the method includes receiving the vertical polarized signal through a vertical polarization waveguide connected to the vertical polarization port. The vertical polarization waveguide may be connected to the common waveguide. The method may also include receiving the horizontal polarized signal through a horizontal polarization waveguide connected to the horizontal polarization port. The horizontal polarization waveguide may be configured to define a first curved path and a second curved path oriented differently from the first curved path. The horizontal polarization waveguide may define a bifurcation into first and second bifurcated waveguides, the first and second bifurcated waveguides connected to the common waveguide.

The first curved path of the horizontal polarization waveguide may be disposed in a first plane and the second curved path of the horizontal polarization waveguide may be disposed in a second plane substantially perpendicular to the first plane. Each bifurcated waveguide may define a third curved path disposed in a third plane parallel to the second plane and a fourth curved path disposed in a fourth plane parallel to the first plane. The common waveguide may define a bifurcation junction having a square cross-sectional shape. The bifurcation junction may be connected to the first and second bifurcated waveguides of the horizontal polarization waveguide. The common port of the orthogonal-mode transducer may define a circular cross-sectional shape, and the vertical polarization port and the horizontal polarization port may each define a rectangular cross-sectional shape.

In some examples, the vertical polarization diplexer includes: a vertical polarization transmit port; a vertical polarization receive port; and a vertical polarization common port in communication with the vertical polarization transmit port, the vertical polarization receive port, and the vertical polarization port of the orthogonal-mode transducer. The vertical polarization diplexer may also include: a vertical polarization transmit waveguide connected to the vertical polarization transmit port and the vertical polarization common port; a vertical polarization receive waveguide connected to the vertical polarization receive port and the vertical polarization common port; and a vertical polarization common waveguide connected to the vertical polarization common port and the vertical polarization port of the orthogonal-mode transducer. The vertical polarization transmit waveguide, the vertical polarization receive waveguide, and the vertical polarization common waveguide may each define a rectangular cross-sectional shape. The vertical polarization transmit waveguide and the vertical polarization receive waveguide may be configured to receive a corresponding vertical polarized transmit signal and a corresponding vertical polarized receive signal at different frequencies.

In some examples, the horizontal polarization diplexer includes: a horizontal polarization transmit port; a horizontal polarization receive port; and a horizontal polarization common port in communication with the horizontal polarization transmit port, the horizontal polarization receive port, and the horizontal polarization port of the orthogonal-mode transducer. The horizontal polarization diplexer may also include: a horizontal polarization transmit waveguide connected to the horizontal polarization transmit port and the horizontal polarization common port; a horizontal polarization receive waveguide connected to the horizontal polarization receive port and the horizontal polarization common port; and a horizontal polarization common waveguide connected to the horizontal polarization common port and the horizontal polarization port of the orthogonal-mode transducer. The horizontal polarization transmit waveguide, the horizontal polarization receive waveguide, and the horizontal polarization common waveguide may each define a rectangular cross-sectional shape. The horizontal polarization transmit waveguide and the horizontal polarization receive waveguide may be configured to receive a corresponding horizontal polarized transmit signal and a corresponding horizontal polarized receive signal at different frequencies.

In some implementations, the vertical polarization transmit waveguide is configured to receive the vertical polarized transmit signal having a frequency between about 81 GHz and about 86 GHz. The vertical polarization receive waveguide may be configured to receive the vertical polarized receive signal having a frequency between about 71 GHz and about 76 GHz. The horizontal polarization transmit waveguide may be configured to receive the horizontal polarized transmit signal having a frequency between about 81 GHz and about 86 GHz. The horizontal polarization receive waveguide may be configured to receive the horizontal polarized receive signal having a frequency between about 71 GHz and about 76 GHz.

In some examples, the method includes receiving the vertical polarized signal through the vertical polarization diplexer to/from a vertical polarization radio having a vertical polarization transmit output in communication with the vertical polarization transmit port of the vertical polarization diplexer and a vertical polarization receive input in communication with the vertical polarization receive port of the vertical polarization diplexer. The method may also include receiving the horizontal polarized signal through the horizontal polarization diplexer to/from a horizontal polarization radio having a horizontal polarization transmit output in communication with the horizontal polarization transmit port of the horizontal polarization diplexer and a horizontal polarization receive input in communication with the horizontal polarization receive port of the horizontal polarization diplexer.

In some examples, the method includes receiving the vertical polarized transmit signal through a vertical polarization powered amplifier connected to the vertical polarization transmit output of the vertical polarization radio and the vertical polarization transmit port of the vertical polarization diplexer and receiving the vertical polarized receive signal through a vertical polarization low noise amplifier connected to the vertical polarization receive input of the vertical polarization radio and the vertical polarization receive port of the vertical polarization diplexer. The method may also include receiving the horizontal polarized transmit signal through a horizontal polarization powered amplifier connected to the horizontal polarization transmit output of the horizontal polarization radio and the horizontal polarization transmit port of the horizontal polarization diplexer and receiving the horizontal polarized receive signal through a horizontal polarization low noise amplifier connected to the horizontal polarization receive input of the horizontal polarization radio and the horizontal polarization receive port of the horizontal polarization diplexer.

Another aspect of the disclosure provides a system for splitting or combining between a circular polarized signal and vertical and horizontal polarized signals. The system includes an orthogonal-mode transducer having a vertical polarization port, a horizontal polarization port, and a common port. The common port is in communication with the vertical polarization port and the horizontal polarization port and is configured to communicate with an antenna. The system also includes a vertical polarization diplexer having a vertical polarization transmit port, a vertical polarization receive port, and a vertical polarization common port. The vertical polarization common port is in communication with the vertical polarization port of the orthogonal-mode transducer. The system further includes a horizontal polarization diplexer having a horizontal polarization transmit port, a horizontal polarization receive port, and a horizontal polarization common port. The horizontal polarization common port is in communication with the horizontal polarization port of the orthogonal-mode transducer. The orthogonal-mode transducer includes a septum polarizer connected to the common port and is in communication with the vertical polarization port and the horizontal polarization port. The septum polarizer is configured to split or combine between: a circular polarized signal received through the common port; and a vertical polarized signal received through the vertical polarization port and a horizontal polarized signal received through the horizontal polarization port.

This aspect may include one or more of the following optional features. In some implementations, the orthogonal-mode transducer includes a vertical polarization waveguide connected to the vertical polarization port and a horizontal polarization waveguide connected to the horizontal polarization port. The horizontal polarization waveguide may be configured to define a first curved path and a second curved path oriented differently from the first curved path. The horizontal polarization waveguide may define a bifurcation into first and second bifurcated waveguides. The orthogonal-mode transducer may also include a common waveguide connected to the common port, the vertical polarization waveguide, and the first and second bifurcated waveguides of the horizontal polarization waveguide. The first curved path of the horizontal polarization waveguide may be disposed in a first plane and the second curved path of the horizontal polarization waveguide may be disposed in a second plane substantially perpendicular to the first plane.

Each bifurcated waveguide may define a third curved path disposed in a third plane parallel to the second plane and a fourth curved path disposed in a fourth plane parallel to the first plane. The common waveguide may define a bifurcation junction having a square cross-sectional shape. The bifurcation junction may be connected to the first and second bifurcated waveguides of the horizontal polarization waveguide. The common port of the orthogonal-mode transducer may define a circular cross-sectional shape, and the vertical polarization port and the horizontal polarization port may each define a rectangular cross-sectional shape.

In some implementations, the vertical polarization diplexer includes: a vertical polarization transmit waveguide connected to the vertical polarization transmit port and the vertical polarization common port; a vertical polarization receive waveguide connected to the vertical polarization receive port and the vertical polarization common port; and a vertical polarization common waveguide connected to the vertical polarization common port and the vertical polarization port of the orthogonal-mode transducer. The vertical polarization transmit waveguide, the vertical polarization receive waveguide, and the vertical polarization common waveguide may each define a rectangular cross-sectional shape. The vertical polarization transmit waveguide and the vertical polarization receive waveguide may be configured to receive a corresponding vertical polarized transmit signal and a corresponding vertical polarized receive signal at different frequencies.

In some examples, the horizontal polarization diplexer includes: a horizontal polarization transmit waveguide connected to the horizontal polarization transmit port and the horizontal polarization common port; a horizontal polarization receive waveguide connected to the horizontal polarization receive port and the horizontal polarization common port; and a horizontal polarization common waveguide connected to the horizontal polarization common port and the horizontal polarization port of the orthogonal-mode transducer. The horizontal polarization transmit waveguide, the horizontal polarization receive waveguide, and the horizontal polarization common waveguide may each define a rectangular cross-sectional shape. The horizontal polarization transmit waveguide and the horizontal polarization receive waveguide may be configured to receive a corresponding horizontal polarized transmit signal and a corresponding horizontal polarized receive signal at different frequencies.

In some examples, the vertical polarization transmit waveguide is configured to receive the vertical polarized transmit signal having a frequency between about 81 GHz and about 86 GHz. The vertical polarization receive waveguide may be configured to receive the vertical polarized receive signal having a frequency between about 71 GHz and about 76 GHz. The horizontal polarization transmit waveguide may be configured to receive the horizontal polarized transmit signal having a frequency between about 81 GHz and about 86 GHz. The horizontal polarization receive waveguide may be configured to receive the horizontal polarized receive signal having a frequency between about 71 GHz and about 76 GHz.

The system may include a vertical polarization radio having a vertical polarization transmit output in communication with the vertical polarization transmit port of the vertical polarization diplexer and a vertical polarization receive input in communication with the vertical polarization receive port of the vertical polarization diplexer. The system may also include a horizontal polarization radio having a horizontal polarization transmit output in communication with the horizontal polarization transmit port of the horizontal polarization diplexer and a horizontal polarization receive input in communication with the horizontal polarization receive port of the horizontal polarization diplexer.

In some examples, a vertical polarization powered amplifier (PA) is connected to the vertical polarization transmit output of the vertical polarization radio and the vertical polarization transmit port of the vertical polarization diplexer. The system may include a vertical polarization low noise amplifier (LNA) connected to the vertical polarization receive input of the vertical polarization radio and the vertical polarization receive port of the vertical polarization diplexer. In some examples, a horizontal polarization powered amplifier is connected to the horizontal polarization transmit output of the horizontal polarization radio and the horizontal polarization transmit port of the horizontal polarization diplexer. The system may also include a horizontal polarization low noise amplifier connected to the horizontal polarization receive input of the horizontal polarization radio and the horizontal polarization receive port of the horizontal polarization diplexer.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
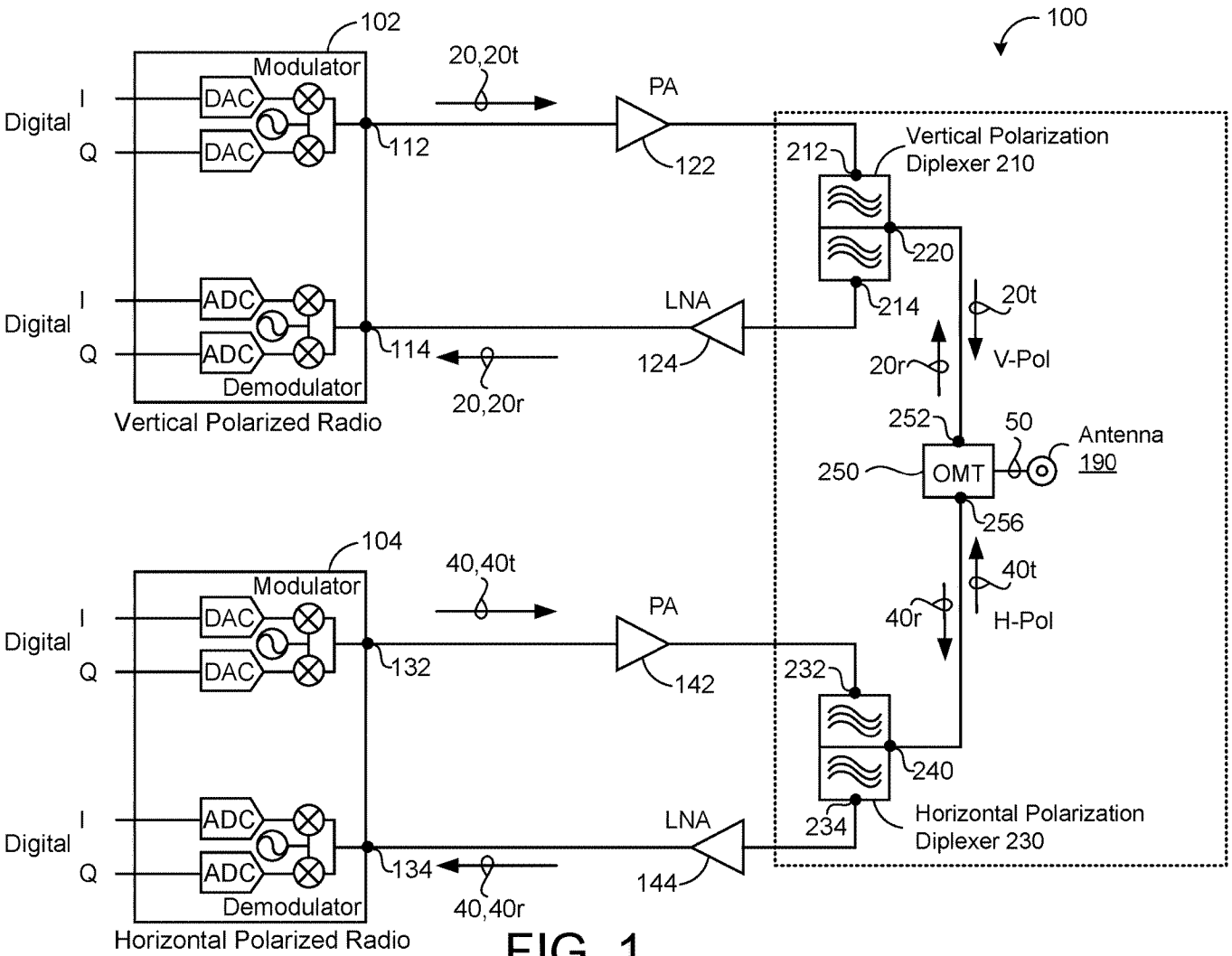
FIG. 1 is a schematic view of example vertical and horizontal polarization radios each in communication with an example integrated orthogonal-mode transducer-diplexer (OMT-diplexer).

Referring to FIG. 1, in some implementations, a system 100 includes a vertical polarized radio 102 and a horizontal polarized radio 104 configured to communicate with an antenna 190 through an integrated unit 200 that includes a vertical polarization diplexer 210, a horizontal polarization diplexer 230, and an orthogonal-mode transducer (OMT) 250. The OMT 250 may also be referred to as an ortho-mode transducer. The vertical polarized radio 102 is configured to transmit/receive vertical polarized signals 20, 20*t*, 20*r* to/from the OMT 250 through the vertical polarization diplexer 210, and the horizontal polarized radio 104 is configured to transmit/receive horizontal polarized signals 40, 40*t*, 40*r* to/from the OMT 250 through the horizontal polarization diplexer 230. The integrated unit 200 may be interchangeably referred to as an integrated OMT-diplexer 200.

In the example shown, the vertical polarization diplexer 210 includes a vertical polarization common port 220 that communicates with a vertical polarization port 252 of the OMT 250, and the horizontal polarization diplexer 230 includes a horizontal polarization common port 240 that communicates with a horizontal polarization port 256 of the OMT 250. In some examples, the OMT 250 combines a vertical polarized transmit signal 20, 20*t* from the vertical polarized radio 102 and a horizontal polarized transmit signal 40, 40*t* from the horizontal polarized radio 104 into a circular polarized signal 50 for transmission through the antenna 190. In other examples, the OMT 250 receives the circular polarized signal 50 through the antenna 190 and splits the circular polarized signal 50 into a vertical polarized receive signal 20, 20*r* and a horizontal polarized receive signal 40, 40*r*. The OMT 250 may direct the vertical polarized receive signal 20*r* to the vertical polarized radio 102 through the vertical polarization diplexer 210 and the horizontal polarized receive signal 40*r* to the horizontal polarized radio 104 through the horizontal polarization diplexer 230.

The vertical polarization radio 102 has a vertical polarization transmit output 112 in communication with a vertical polarization transmit port 212 of the vertical polarization diplexer 210 for transmitting the vertical polarized transmit signal 20*t* to the vertical polarization diplexer 210. In some implementations, a vertical polarization powered amplifier (PA) 122 connected to the vertical polarization transmit output 112 and the vertical polarization transmit port 212 amplifies the vertical polarized transmit signal 20*t* before the vertical polarization transmit port 212 of the vertical polarization diplexer 210 receives the vertical polarized transmit signal 20*t*. Additionally, the vertical polarization radio 102 has a vertical polarization receive input 114 in communication with a vertical polarization receive port 214 of the vertical polarization diplexer 210 for receiving the vertical polarized receive signal 20*r* from the vertical polarization diplexer 210. In some implementations, a vertical polarization low-noise amplifier (LNA) 124 connected to the vertical polarization receive port 214 amplifies the vertical polarized receive signal 20*r*.

Still referring to FIG. 1, the horizontal polarization radio 104 has a horizontal polarization transmit output 132 in communication with a horizontal polarization transmit port 232 of the horizontal polarization diplexer 230 for transmitting the horizontal polarized transmit signal 40*t* to the horizontal polarization diplexer 230. In some implementations, a horizontal polarization PA 142 connected to the horizontal polarization transmit output 132 and the horizontal polarization transmit port 232 amplifies the horizontal polarized transmit signal 40*t* before the horizontal polarization transmit port 232 of the horizontal polarization diplexer 230 receives the horizontal polarized transmit signal 40*t*. Additionally, the horizontal polarization radio 104 has a horizontal polarization receive input 134 in communication with a horizontal polarization receive port 234 of the horizontal polarization diplexer 230 for receiving the horizontal polarized receive signal 40*r* from the horizontal polarization diplexer 230. In some implementations, a horizontal LNA 144 connected to the horizontal polarization receive port 234 amplifies the horizontal polarized receive signal 40*r*.

The vertical and horizontal polarized radios 102, 104 each includes transmit circuitry including a digital transmit signal input configured to receive in-phase (I) data (I) and quadrature (Q) data and a digital-to-analog converter(s) (DAC) configured to convert the I/Q data from the digital domain to the analog domain. The transmit circuitry further includes a modulator in communication with the DAC and configured to modulate the analog I/Q data into an analog transmit signal 20*t*, 40*t* for transmission out the corresponding transmit output 112, 132.

The vertical and horizontal polarized radios 102, 104 also include receive circuitry including the corresponding receive input 114, 134 configured to receive an analog receive signal 20*r*, 40*r* and a demodulator in communication with the receive input 114, 134. The demodulator is configured to demodulate the analog receive signal 20*r*, 40*r* into corresponding analog I/Q data. The receive circuitry further includes an analog-to-digital converter(s) (ADC) configured to convert the analog I/Q data from the analog domain to the digital domain. An analog receive signal output in communication with the ADC may output the digital I/Q data.

Figure 2A:
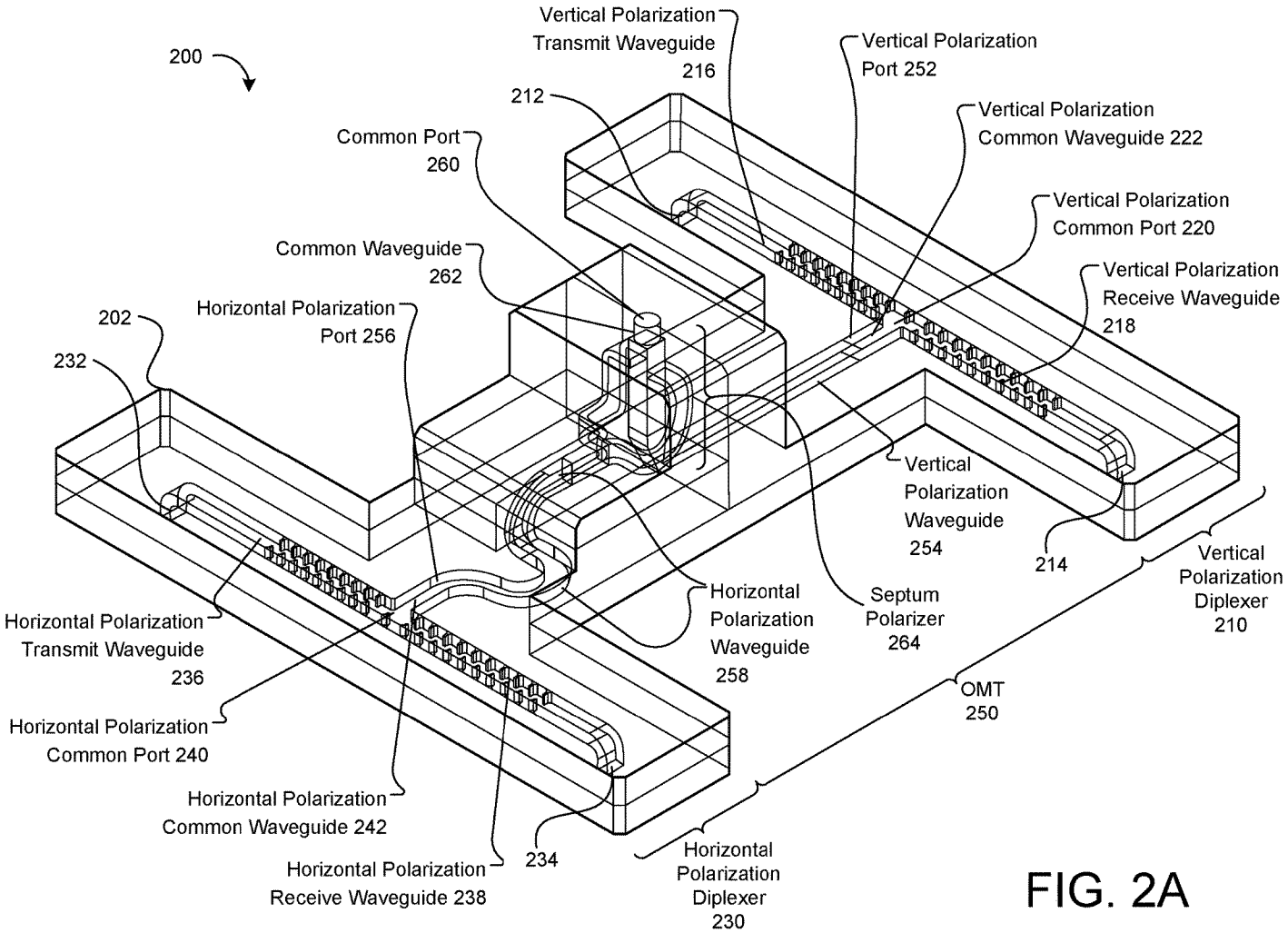
FIGS. 2A-2C are schematic views of the integrated OMT-diplexer of FIG. 1.
Figure 2B:
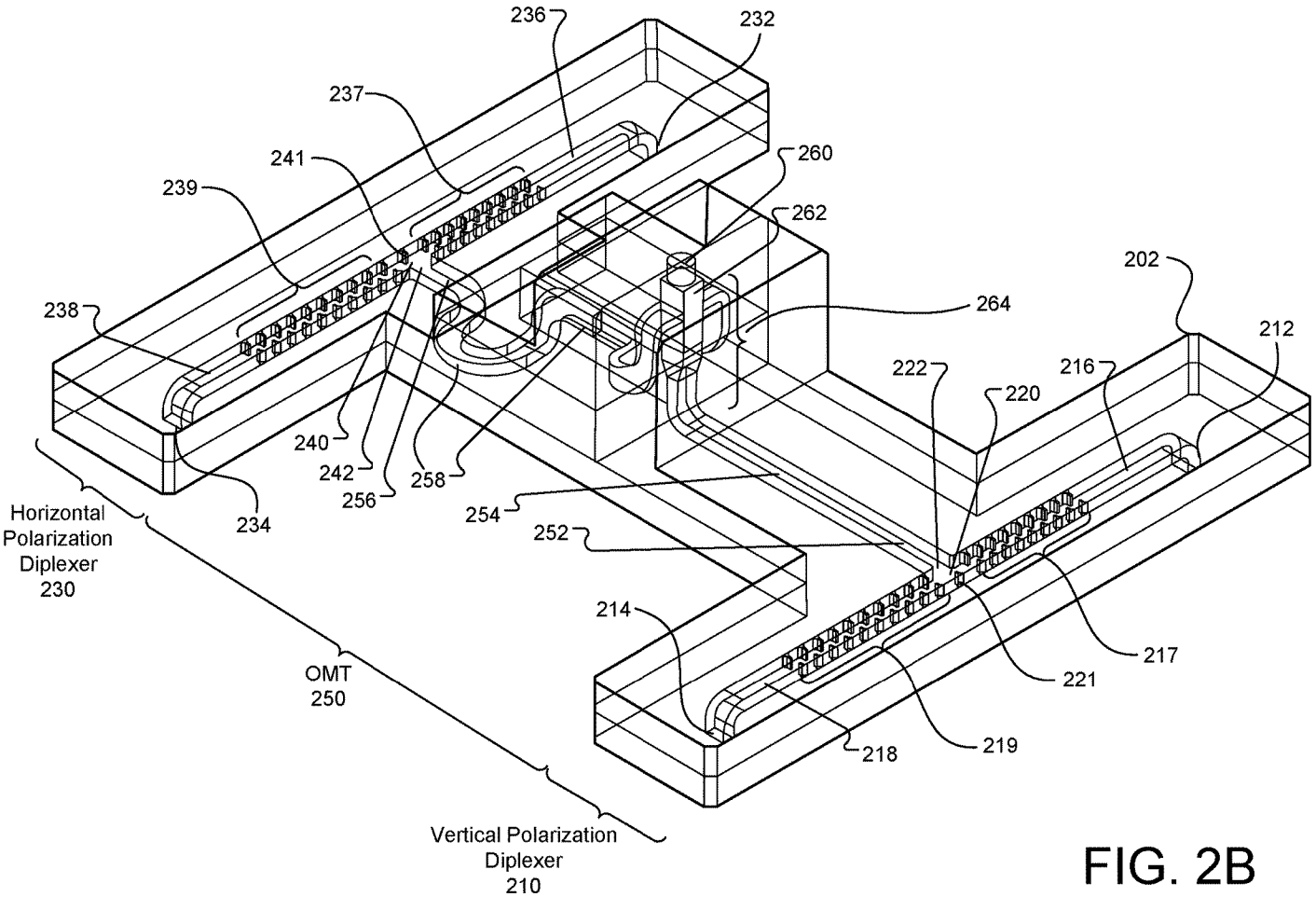
Figure 2C:
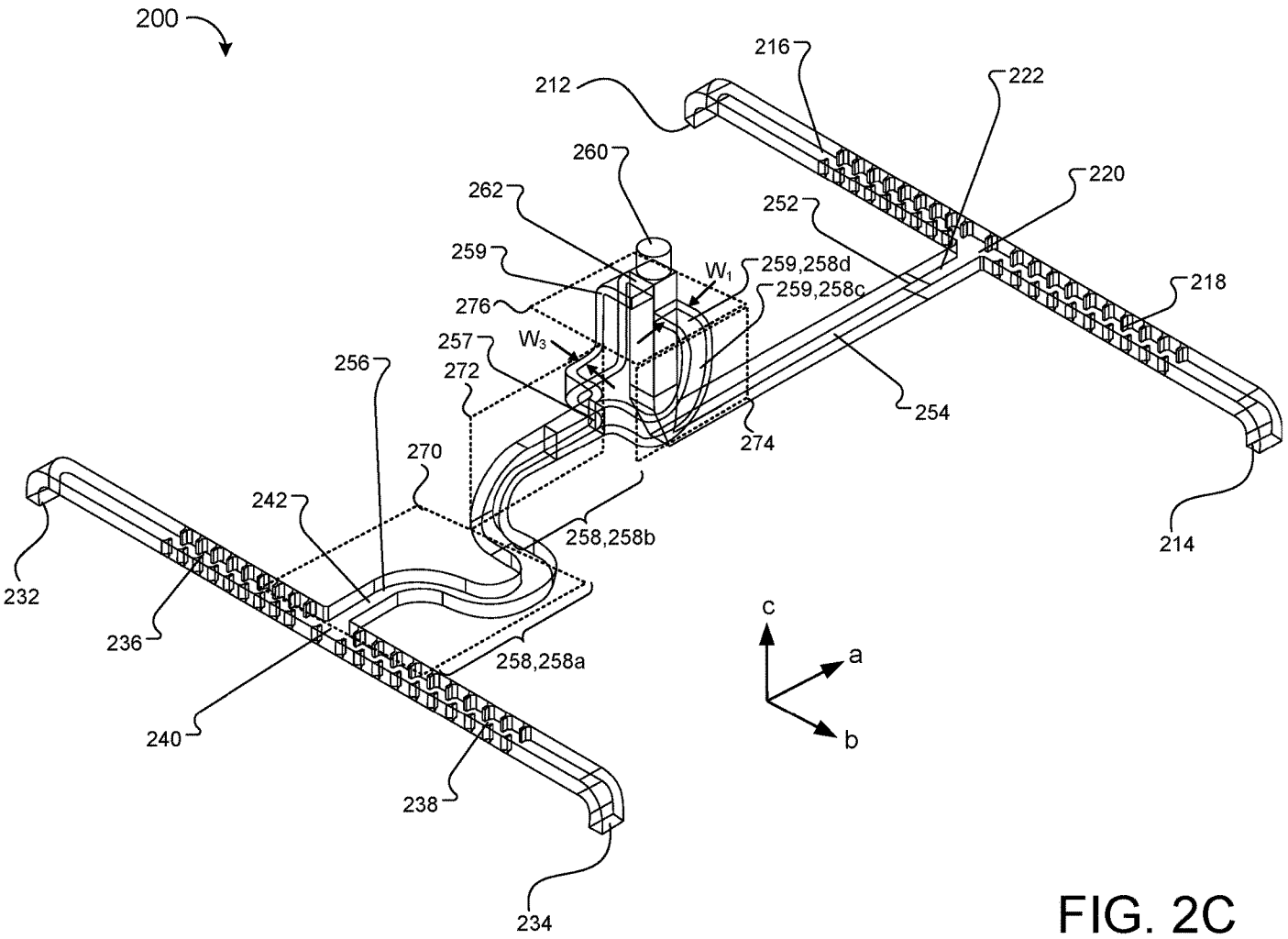

FIGS. 2A-2E provide schematic views of the integrated OMT-diplexer 200 of FIG. 1. FIGS. 2A and 2B show a housing 202 defining various enclosed ports and waveguides configured to direct the vertical and horizontal polarized signals 20, 40 between the antenna 190 and the corresponding vertical polarized radio 102 or the horizontal polarized radio 104. FIG. 2C shows the housing 202 removed for clarity.

In some implementations, the OMT 250 includes a vertical polarization waveguide 254 connected to the vertical polarization port 252, a horizontal polarization waveguide 258 connected to the horizontal polarization port 256, and a common port 260 connected to a common waveguide 262 and configured to communicate with the antenna 190. The common waveguide 262 connects to each of the vertical polarization waveguide 254 and the horizontal polarization waveguide 258 to provide communication between the common port 260 and each of the vertical polarization port 252 and the horizontal polarization port 256. For instance, the vertical polarization waveguide 254 is configured to direct the vertical polarized transmit signal 20*t* received through the vertical polarized port 252 from the vertical polarization diplexer 210 to the common waveguide 262, and direct the vertical polarized received signal 20*r* received from the common waveguide 262 to the vertical polarized port 252. Similarly, the horizontal polarization waveguide 258 is configured to direct the horizontal polarized transmit signal 40*t* received through the horizontal polarized port 256 from the horizontal polarization diplexer 230 to the common waveguide 262, and direct the horizontal polarized received signal 40*r* received from the common waveguide 262 to the horizontal polarized port 256. In some examples, the vertical polarization waveguide 254 is substantially straight and the horizontal polarization waveguide 258 includes multiple bends.

In the examples shown, the common waveguide 262 of the OMT 250 includes a septum polarizer 264 configured to split or combine between: (1) the circular polarized signal 50 received through the common port 260; and (2) the vertical polarized signal 20 and the horizontal polarized signal 40. In some examples, the septum polarizer 264 splits the circular polarized signal 50 received through the common port 260 from the antenna 190 into the vertical polarized receive signal 20*r* and the horizontal polarized receive signal 40*r*. In other examples, the septum polarizer 264 combines the vertical polarized transmit signal 20*t* received through the vertical polarization port 252 and the horizontal polarized transmit signal 40*t* received through the horizontal polarization port 256 into the circular polarized signal 50 prior to transmission through the antenna 190. The septum polarizer 264 may obtain an insertion loss at the input ports 212, 214, 232, 234 of less than one (1.0) decibels (dB) with return losses exceeding eighteen (18) dB. Moreover, the septum polarizer 264 of the integrated OMT-diplexer 200 may achieve cross-polarization power levels that exceed sixty-five (65) dB and isolation exceeding seventy-five (75) dB.

Referring to the vertical polarization diplexer 210, the vertical polarization transmit port 212 connects to a vertical polarization transmit waveguide 216 at a first end, the vertical polarization receive port 214 connects to a vertical polarization receive waveguide 218 at a second end, and a vertical polarization common port 220 connects to a corresponding second end of each of the vertical polarization transmit waveguide 216 and the vertical polarization receive waveguide 218. In some implementations, a vertical polarization common waveguide 222 connects the vertical polarization common port 220 to the vertical polarization port 252 of the OMT 250 to thereby place the vertical polarization common port 220 in communication with the vertical polarization transmit port 212, the vertical polarization receive port 214, and the vertical polarization port 252 of the OMT 250.

The vertical polarization transmit waveguide 216 is configured to receive the vertical polarized transmit signal 20*t* from the vertical polarized radio 102 via the vertical polarization transmit port 212. The vertical polarization receive waveguide 218 is configured to receive the vertical polarized receive signal 20*r* from the OMT 250 via the vertical polarization common port 220. In some examples, the vertical polarization transmit waveguide 216 and the vertical polarization receive waveguide 218 receive the corresponding vertical polarized transmit signal 20*t* and the corresponding vertical polarized receive signal 20*r* at different frequencies. In one example, the vertical polarization transmit waveguide 216 is configured to receive the vertical polarized transmit signal 20*t* having a frequency between about 81 Gigahertz (GHz) and about 86 GHz, and the vertical polarization receive waveguide 218 is configured to receive the vertical polarized receive signal 20*r* having a frequency between about 71 GHz and about 76 GHz. Accordingly, the vertical polarization transmit waveguide 216 may correspond to a high-band frequency of the vertical polarization diplexer 210 and the vertical polarization receive waveguide 218 may correspond to a low-band frequency of the vertical polarization diplexer 210.

As shown in FIG. 2B, the vertical polarization transmit waveguide 216 and the vertical polarization receive waveguide 218 may each have a corresponding band pass filter (BPF) 217, 219, and the horizontal polarization common port 240 may include a septum 241. In some configurations, the vertical polarization transmit waveguide 216 implements a $10^{th}$ order Chebyshev BPF 217 using an inductive iris technique and the vertical horizontal polarization transmit waveguide 218 implements a $9^{th}$ order Chebyshev BPF 219 using the inductive iris technique. However, one or both of the waveguides 216, 218 may use capacitive filters in other configurations. The order of the BPFs 217, 219 may be based on the specified rejection. The vertical polarization transmit waveguide 216, the vertical polarization receive waveguide 218, and the vertical polarization common waveguide 222 may each define a rectangular cross-sectional shape.

Referring now to the horizontal polarization diplexer 230, the horizontal polarization transmit port 232 connects to a horizontal polarization transmit waveguide 236 at a first end, the horizontal polarization receive port 234 connects to a horizontal polarization receive waveguide 238 at a second end, and a horizontal polarization common port 240 connects to a corresponding second end of each of the horizontal polarization transmit waveguide 236 and the horizontal polarization receive waveguide 238. In some implementations, a horizontal polarization common waveguide 242 connects the horizontal polarization common port 240 to the horizontal polarization port 256 of the OMT 250 to thereby place the horizontal polarization common port 240 in communication with the horizontal polarization transmit port 232, the horizontal polarization receive port 234, and the horizontal polarization port 256 of the OMT 250.

The horizontal polarization transmit waveguide 236 is configured to receive the horizontal polarized transmit signal 40*t* from the horizontal polarized radio 104 via the horizontal polarization transmit port 232. The horizontal polarization receive waveguide 238 is configured to receive the horizontal polarized receive signal 40*r* from the OMT 250 via the horizontal polarization common port 240. In some examples, the horizontal polarization transmit waveguide 236 and the horizontal polarization receive waveguide 238 receive the corresponding horizontal polarized transmit signal 40*t* and the corresponding horizontal polarized receive signal 40*r* at different frequencies. In one example, the horizontal polarization transmit waveguide 236 is configured to receive the horizontal polarized transmit signal 40*t* having a frequency between about 81 GHz and about 86 GHz, and the horizontal polarization receive waveguide 238 is configured to receive the horizontal polarized receive signal 40*r* having a frequency between about 71 GHz and about 76 GHz. Accordingly, the horizontal polarization transmit waveguide 236 may correspond to a high-band frequency of the horizontal polarization diplexer 230 and the horizontal polarization receive waveguide 238 may correspond to a low-band frequency of the horizontal polarization diplexer 230.

As shown in FIG. 2B, the horizontal polarization transmit waveguide 236 and the horizontal polarization receive waveguide 238 may each have a corresponding band pass filter (BPF) 237, 239, and the horizontal polarization common port 240 may include a septum 241. In some configurations, the horizontal polarization transmit waveguide 236 implements a $10^{th}$ order Chebyshev BPF 237 using an inductive iris technique and the horizontal polarization transmit waveguide 238 implements a $9^{th}$ order Chebyshev BPF 239 using the inductive iris technique. However, one or both of the waveguides 236, 238 may use capacitive filters in other configurations. The order of the BPFs 237, 239 may be based on the specified rejection. The horizontal polarization transmit waveguide 236, the horizontal polarization receive waveguide 238, and the horizontal polarization common waveguide 242 may each define a rectangular cross-sectional shape.

In the examples shown, the vertical polarization waveguide 254 of the OMT 250 is substantially straight and extends between the vertical polarization port 252 and the common waveguide 262. The vertical polarization waveguide 254 is configured to receive the vertical polarized signal 20 that may include the vertical polarized transmit signal 20*t* and/or the vertical polarized receive signal 20*r*. For instance, the vertical polarized transmit signal 20*t* may travel through the vertical polarized waveguide 254 in a direction from the vertical polarization port 252 to the common waveguide 262. On the other hand, the vertical polarized receive signal 20*r* may travel through the vertical polarized waveguide 254 in an opposite direction from the common waveguide 262 to the vertical polarization port 252.

Whereas the vertical polarization waveguide 254 may be substantially straight, the horizontal polarization waveguide 258 may include a double bend waveguide. The double bend horizontal polarization waveguide 258 is configured to receive the horizontal polarized signal 40 that may include the horizontal polarized transmit signal 40*t* and/or the horizontal polarized receive signal 40*r*. For instance, the horizontal polarized transmit signal 40*t* may travel through the horizontal polarized waveguide 258 in a direction from the horizontal polarization port 256 to the common waveguide 262. On the other hand, the horizontal polarized receive signal 40*r* may travel through the horizontal polarized waveguide 258 in an opposite direction from the common waveguide 262 to the horizontal polarization port 256.

Referring to FIG. 2C, in some implementations, the horizontal polarization waveguide 258 defines a first curved path 258*a* and a second curved path 258*b* oriented differently than the first curved path 258*a*. In the example shown, the first curved path 258*a* is disposed in a first plane 270 and the second curved path 258*b* is disposed in a second plane 272 substantially perpendicular to the first plane 270. In the example shown, the first plane 270 is coplanar with the a-b plane and the second plane 272 is coplanar with the a-c plane. FIG. 2D shows the first and second curved paths 258*a*, 258*b* of the horizontal polarization waveguide 258 disposed in the corresponding first and second planes 270, 272 substantially perpendicular to one another. As the horizontal polarization waveguide 258 defines a rectangular cross-sectional shape that rotates 90-degrees between the first curved path 258*a* and the second curved path 258*b*, the first curved path 258*a* defines a first width $W_1$ and the second curved path defines a second width $W_2$ that is less than the first width $W_1$.

Referring back to FIG. 2C, the horizontal polarization waveguide 258 further defines a bifurcation 257 into first and second bifurcated waveguides 259 each connected to the common waveguide 262. In the example shown, each bifurcated waveguide 259 defines a third curved path 258*c* disposed in a third plane 274 parallel to the second plane 272 and a fourth curved path 258*d* disposed in a fourth plane 276 parallel to the first plane 270. The third curved path 258*c* may define a third width $W_3$ that is substantially half of the second width $W_2$ (FIG. 2D), while the fourth curved path 258*d* rotates 90-degrees from the third curved path 258*c* to define the first width $W_1$. Accordingly, the fourth curved path 258*d* defined by each of the bifurcated waveguides 259 converts the horizontal polarization waveguide 258 back to the same orientation as the horizontal polarization port 256 before connecting to the common waveguide 262. In some implementations, the bifurcation 257 power splits the horizontal polarized transmit signal 40*t* into two split signals each directed to the common waveguide 262 along the corresponding first or second bifurcated waveguide 259. For instance, each of the horizontal polarized transmit signals 40*t* power split by the bifurcation 257 travel along the third and fourth curved paths 258*c*, 258*d* of the corresponding bifurcated waveguide 259 and then combine within the common waveguide 262.

Figure 2E:
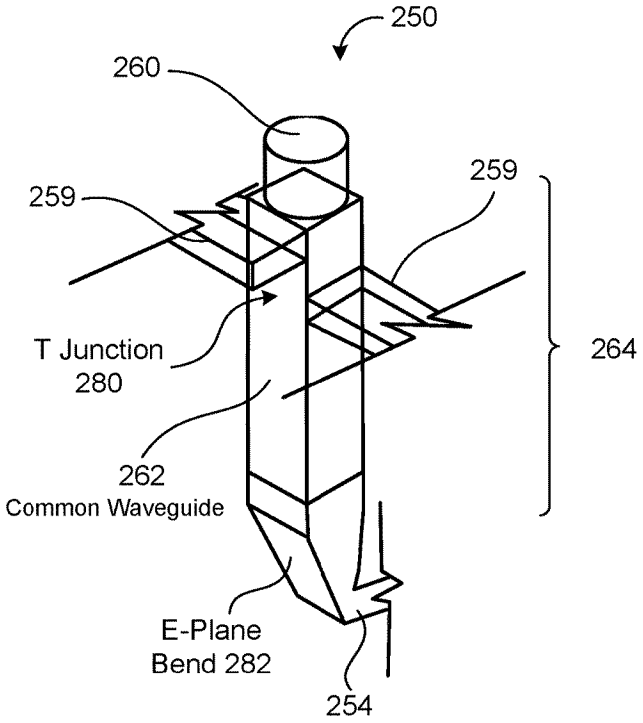
FIG. 2E is a schematic view of a common waveguide of the integrated OMT-diplexer of FIG. 1.
Figure 2D:
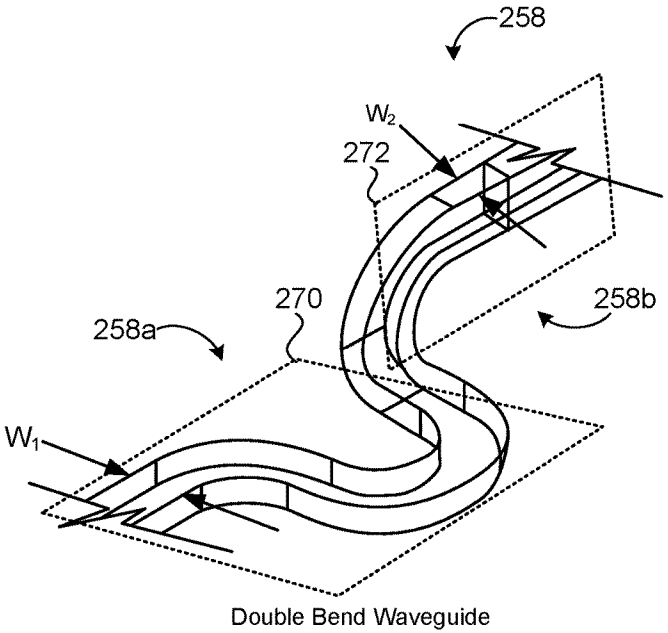
FIG. 2D is a schematic view of a double bended horizontal polarization waveguide of the integrated OMT-diplexer of FIGS. 2A-2C.

FIG. 2E shows the common waveguide 262 of the OMT 250 defining a bifurcation junction 280 (e.g., T-junction) connecting each of the bifurcation waveguides 259 to the common waveguide 262. The bifurcation junction 280 defines a square cross-sectional shape, while each of the bifurcation waveguides 259 define the rectangular cross-sectional shape. Accordingly, the horizontal polarized transmit signals 40*t* recombine within the common waveguide 262 defining the square cross-sectional shape. Moreover, an E-Plane bend 282 is configured to connect the vertical polarization waveguide 254 defining the rectangular cross-sectional shape to the common waveguide 262 defining the square cross-sectional shape. Thereafter, the septum polarizer 264 combines the vertical polarized transmit signal 20*t* received through the vertical polarization waveguide 254 and the horizontal polarized transmit signals 40*t* received through the bifurcation waveguides 259 into the circular polarized signal 50. The circular polarized signal travels through the common port 260 for transmission from the antenna 190 (FIG. 1).

Figure 2F:
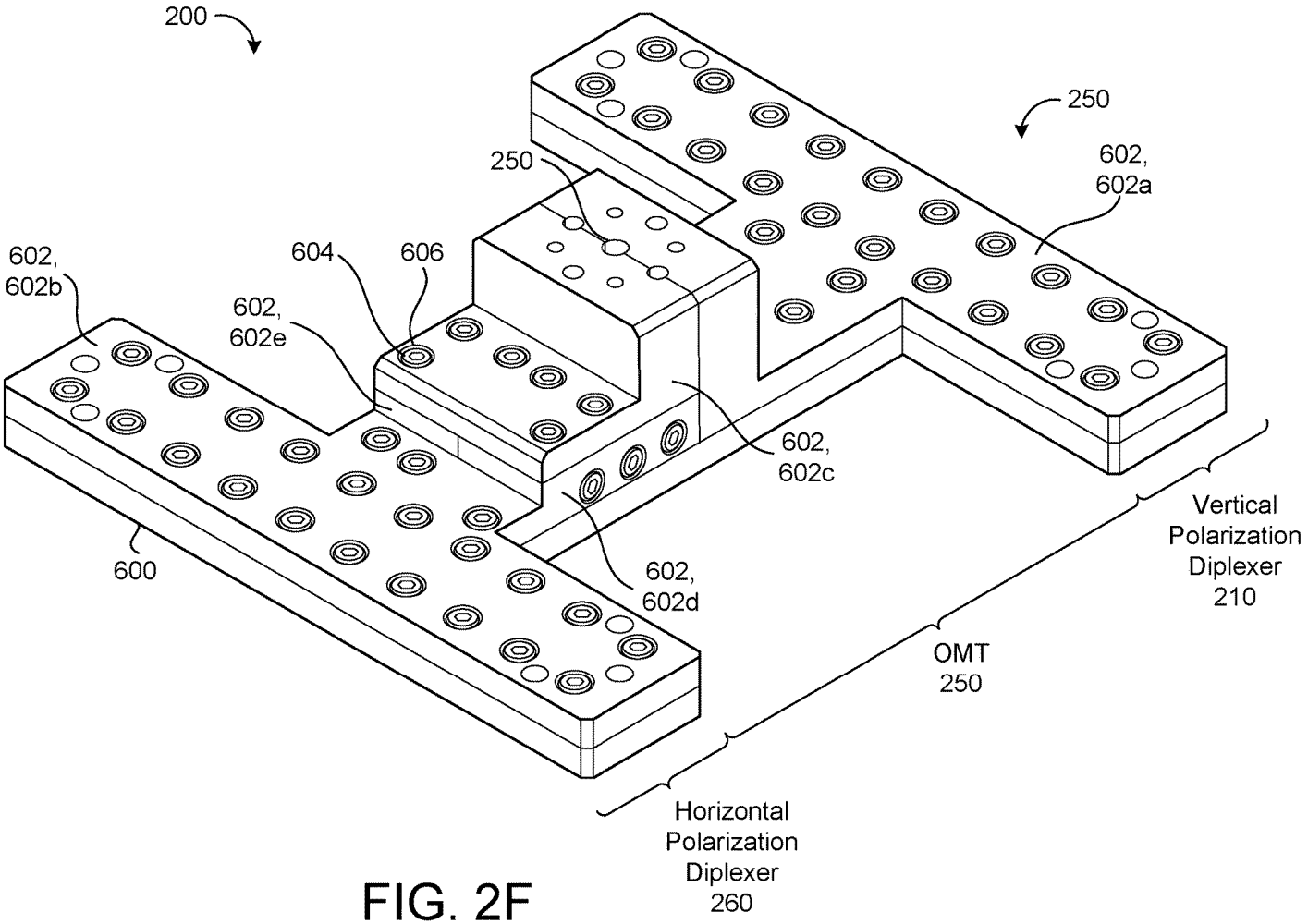
FIG 2F is a perspective view of an example OMT-diplexer.

Referring to FIG. 2F, in some implementations, the housing 202 (FIGS. 2A and 2B) of the integrated OMT-diplexer 200 is formed by a base plate 600 and a plurality of upper plates 602, 602*a-e* each securing to the base plate 600. For instance, fasteners 604 may extend through corresponding holes 606 formed through the upper plates 602 and the base plate 600 to secure each upper plate 602 to the base plate 600. The fasteners 604 may include pins or screws. In some examples, the holes 606 are threaded and adapted to threadably engage with threaded screws 604. Other fastening techniques may be employed to secure the upper plates 602 to the base plate 600.

Various grooves and channels are formed through opposing surfaces of the upper plates 602 and the base plate 600 to form the ports and waveguides for directing the vertical and horizontal polarized signals 20, 40 between the radios 102, 104 and the antenna 190. For instance, the upper plate 602*a* and the base plate 600 may cooperate to define the vertical polarized transmit waveguide 216, the vertical polarized receive waveguide 218, and the vertical polarization common waveguide 222 of the vertical polarization diplexer 210, as well as the vertical polarization waveguide 254 of the OMT 250. In some examples, the base plate 600 and the upper plates 602 are formed from one or more conductive materials. For instance, the base plate 600 and the upper plates 602 may be formed from 6061 Aluminum. Moreover, the channels forming the ports and waveguides may be lined/coated with a chemical film.

Figure 3:
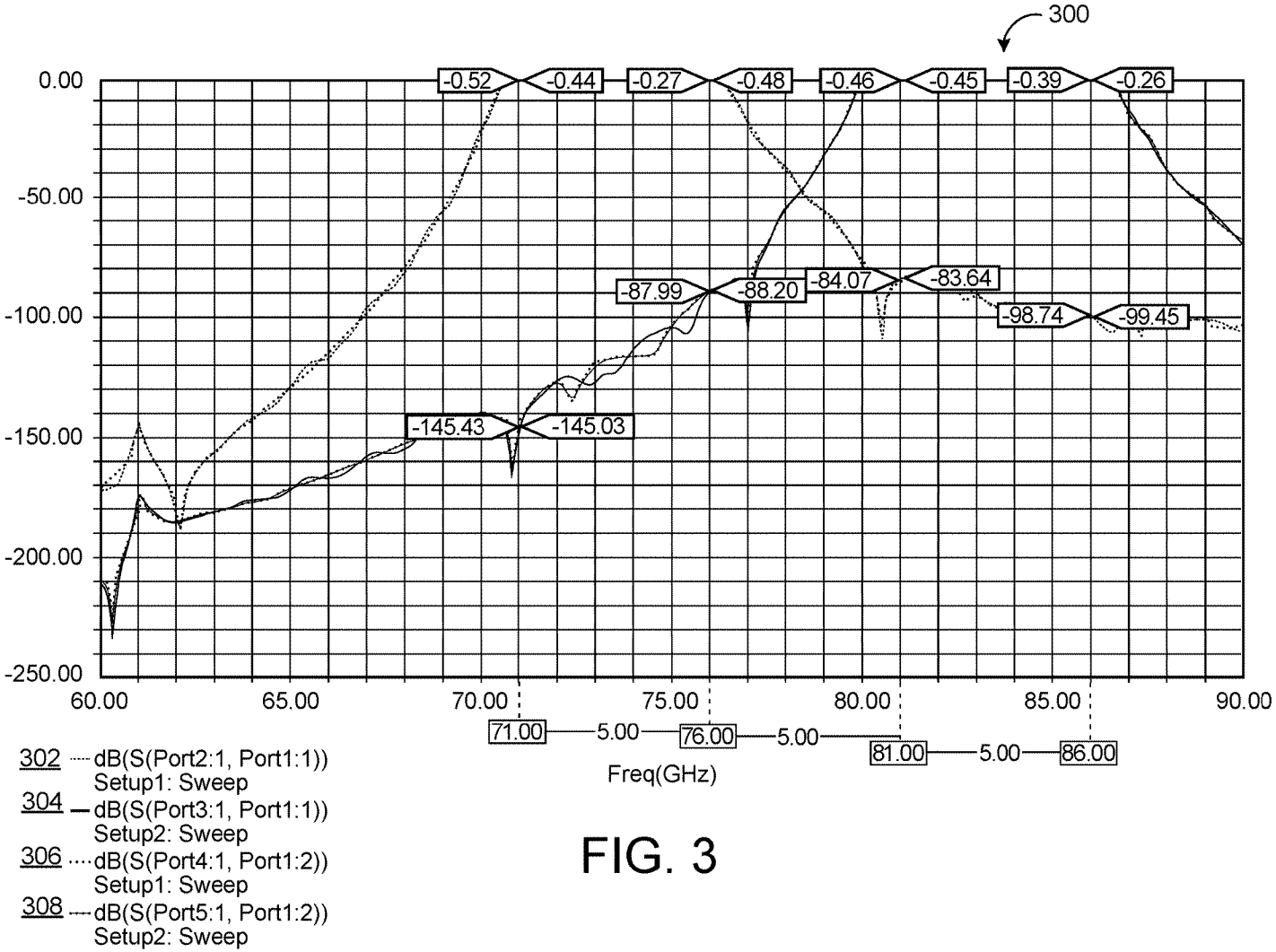
FIG. 3 is a plot showing example insertion loss through the integrated OMT-diplexer of FIG. 1.

FIG. 3 illustrates a plot 300 depicting insertion loss through the integrated OMT-diplexer 200 between the vertical polarization transmit signal 20*t*, the vertical polarization receive signal 20*r*, the horizontal polarization transmit signal 40*t*, and the horizontal polarization receive signal 40*r*. The x-axis depicts frequency in Gigahertz (GHz) and the y-axis depicts insertion loss or loss of signal power in decibels (dB). Profile line 302 corresponds to the insertion loss of the vertical polarization receive signal 20*r*, profile line 304 corresponds to the insertion loss of the vertical polarization transmit signal 20*t*, profile line 306 corresponds to the insertion loss of the horizontal polarization receive signal 40*r*, and profile line 308 corresponds to the insertion loss of the horizontal polarization transmit signal 20*t*. Between frequencies 71.00 GHz and 76.00 GHz, the vertical polarization receive signal 20*r* received through the vertical polarization receive waveguide 218 and the horizontal polarization receive signal 40*r* received through the horizontal polarization receive waveguide 238 each include insertion value losses equal to values less than 1.0 dB. Additionally, between frequencies 81.00 GHz and 86.00 GHz, the vertical polarization transmit signal 20*t* received through the vertical polarization transmit waveguide 216 and the horizontal polarization transmit signal 40*t* received through the horizontal polarization transmit waveguide 236 each include insertion value losses equal to values less than 1.0 dB.

Figure 4:
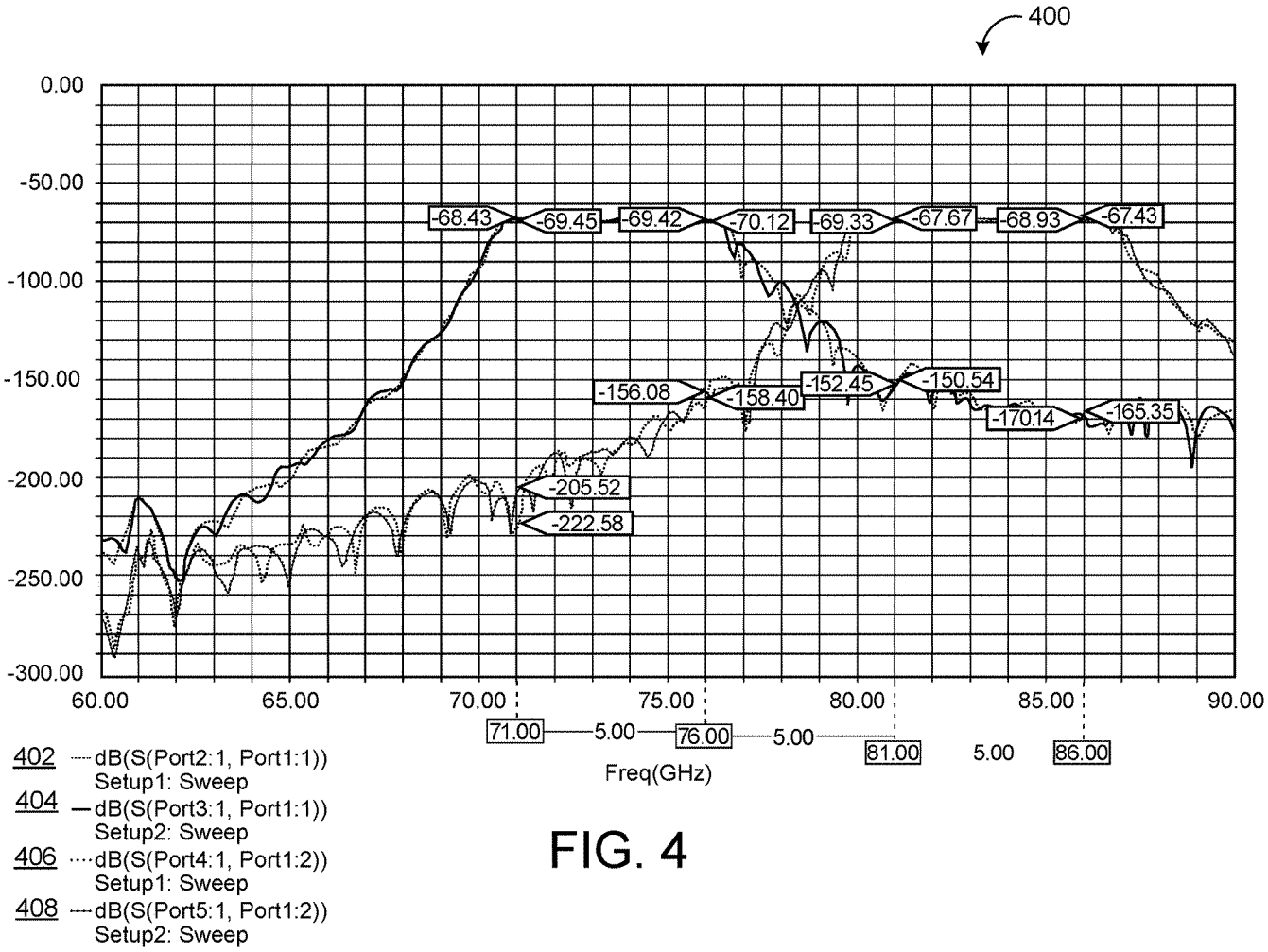
FIG. 4 is a plot showing example cross polarization through the integrated OMT-diplexer of FIG. 1.

FIG. 4 illustrates a plot 400 depicting cross polarization through the integrated OMT-diplexer 200. The x-axis depicts frequency in Gigahertz (GHz) and the y-axis depicts signal power in decibels (dB). Thus, cross polarization is specified as the signal power in negative dB, indicating how many decibels the cross polarization is below a desired polarization associated with the orthogonal polarization. Profile line 402 corresponds to the signal power of the vertical polarization receive signal 20*r*, profile line 404 corresponds to the signal power of the vertical polarization transmit signal 20*t*, profile line 406 corresponds to the signal power of the horizontal polarization receive signal 40*r*, and profile line 408 corresponds to the signal power of the horizontal polarization transmit signal 20*t*. Between frequencies 71.00 GHz and 76.00 GHz, the vertical polarization transmit and receive signals 20*t*, 20*r* include a cross polarization of greater than 65 dB (i.e., less than negative 65 dB). Also, between frequencies 81.00 GHz and 86.00 GHz, the horizontal polarization transmit and receive signals 40*t*, 40*r* include a cross polarization of greater than 65 dB (i.e., less than negative 65 dB).

Figure 5:
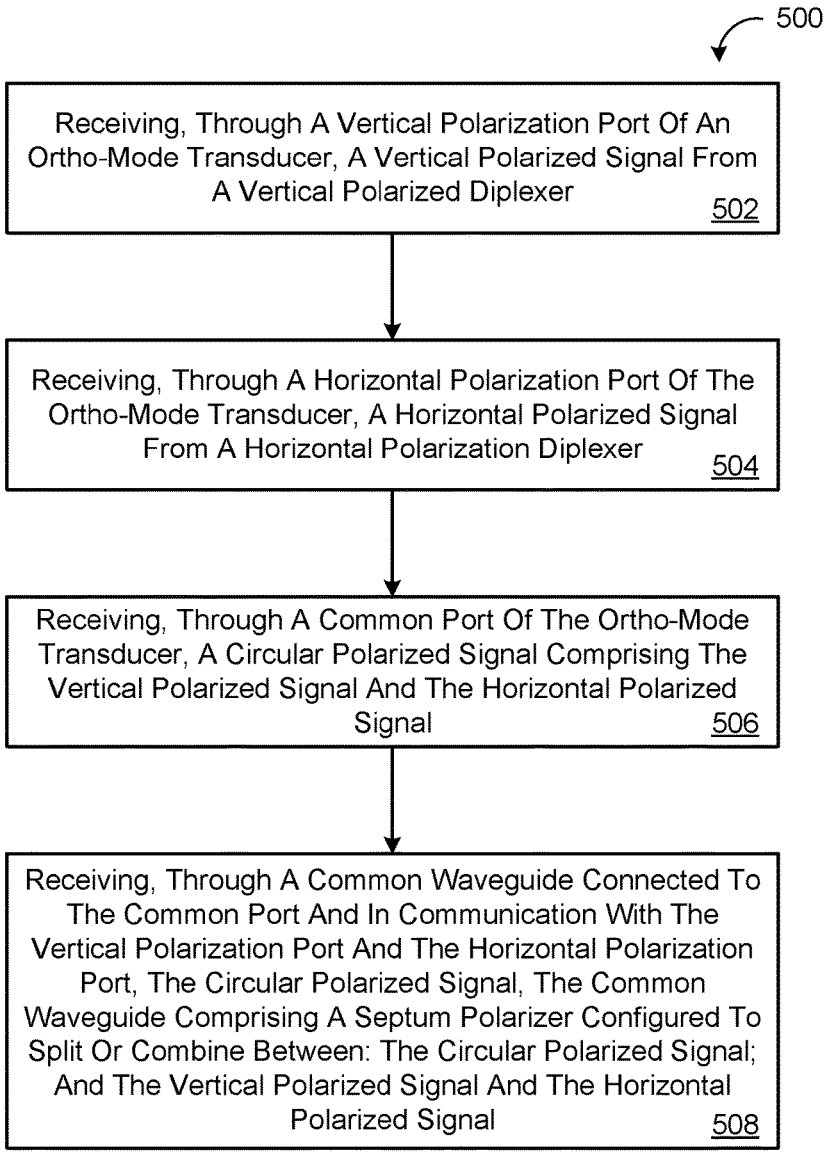
FIG. 5 is an example arrangement of operations for a method of splitting or combining between a circular polarized signal received through a common port of an orthogonal-mode transducer, and a vertical polarized signal and a horizontal polarized signal.

FIG. 5 is a flow chart of an example method 500 of splitting or combining between a circular polarized signal 50 received through a common port 260 of an orthogonal-mode transducer (OMT) 250, and a vertical polarized signal 20 and a horizontal polarized signal 40. At block 502, the method 500 includes receiving, through a vertical polarization port 252 of an ortho-mode transducer 250, a vertical polarized signal 20 from a vertical polarization diplexer 210. At block 504, the method 500 includes receiving, through a horizontal polarization port 256 of the ortho-mode transducer 250, a horizontal polarized signal 40 from a horizontal polarization diplexer 230. At block 506, the method 500 includes receiving, through a common port 260 of the orthogonal-mode transducer 250, a circular polarized signal 50 that includes the vertical polarized signal 20 and the horizontal polarized signal 40. At block 508, the method 500 includes receiving, through a common waveguide 262 connected to the common port 260 and in communication with the vertical polarization port 252 and the horizontal polarization port 256, the circular polarized signal 50. The common waveguide 262 includes a septum polarizer 264 configured to split or combine between the circular polarized signal 50 and the vertical polarized signal 20 and the horizontal polarized signal 40.

A number of implementations have been described. Nevertheless, it will be understood that various modifications may be made without departing from the spirit and scope of the disclosure. Accordingly, other implementations are within the scope of the following claims.

What is claimed is:

1. A method comprising:

receiving, through a vertical polarization port of an ortho-mode transducer, a vertical polarized signal from a vertical polarization diplexer;

receiving, through a horizontal polarization port of the ortho-mode transducer, a horizontal polarized signal from a horizontal polarization diplexer;

receiving, through a common port of the ortho-mode transducer, a circular polarized signal comprising the vertical polarized signal and the horizontal polarized signal; and receiving, through a common waveguide connected to the common port and in communication with the vertical polarization port and the horizontal polarization port, the circular polarized signal, the common waveguide comprising a septum polarizer configured to split or combine between:

the circular polarized signal; and the vertical polarized signal and the horizontal polarized signal, wherein the common port of the ortho-mode transducer defines a circular cross-sectional shape, and the vertical polarization port and the horizontal polarization port each define a rectangular cross-sectional shape.

2. The method of claim 1, further comprising:

receiving the vertical polarized signal through a vertical polarization waveguide connected to the vertical polarization port, the vertical polarization waveguide connected to the common waveguide; and receiving the horizontal polarized signal through a horizontal polarization waveguide connected to the horizontal polarization port, the horizontal polarization waveguide configured to define a first curved path and a second curved path oriented differently from the first curved path, the horizontal polarization waveguide defining a bifurcation into first and second bifurcated waveguides, the first and second bifurcated waveguides connected to the common waveguide.

3. The method of claim 2, wherein the first curved path of the horizontal polarization waveguide is disposed in a first plane and the second curved path of the horizontal polarization waveguide is disposed in a second plane substantially perpendicular to the first plane.

4. The method of claim 3, wherein each bifurcated waveguide defines a third curved path disposed in a third plane parallel to the second plane and a fourth curved path disposed in a fourth plane parallel to the first plane.

5. The method of claim 2, wherein the common waveguide defines a bifurcation junction having a square cross-sectional shape, the bifurcation junction connected to the first and second bifurcated waveguides of the horizontal polarization waveguide.

6. The method of claim 1, wherein:

the vertical polarization diplexer comprises:

a vertical polarization transmit port;

a vertical polarization receive port;

a vertical polarization common port in communication with the vertical polarization transmit port, the vertical polarization receive port, and the vertical polarization port of the ortho-mode transducer;

a vertical polarization transmit waveguide connected to the vertical polarization transmit port and the vertical polarization common port;

a vertical polarization receive waveguide connected to the vertical polarization receive port and the vertical polarization common port; and a vertical polarization common waveguide connected to the vertical polarization common port and the vertical polarization port of the ortho-mode transducer, wherein the vertical polarization transmit waveguide, the vertical polarization receive waveguide, and the vertical polarization common waveguide each define a rectangular cross-sectional shape, and wherein the vertical polarization transmit waveguide and the vertical polarization receive waveguide are configured to receive a corresponding vertical polarized transmit signal and a corresponding vertical polarized receive signal at different frequencies; and the horizontal polarization diplexer comprises:

a horizontal polarization transmit port;

a horizontal polarization receive port;

a horizontal polarization common port in communication with the horizontal polarization transmit port, the horizontal polarization receive port, and the horizontal polarization port of the ortho-mode transducer;

a horizontal polarization transmit waveguide connected to the horizontal polarization transmit port and the horizontal polarization common port;

a horizontal polarization receive waveguide connected to the horizontal polarization receive port and the horizontal polarization common port; and a horizontal polarization common waveguide connected to the horizontal polarization common port and the horizontal polarization port of the ortho-mode transducer, wherein the horizontal polarization transmit waveguide, the horizontal polarization receive waveguide, and the horizontal polarization common waveguide each define a rectangular cross-sectional shape, and wherein the horizontal polarization transmit waveguide and the horizontal polarization receive waveguide are configured to receive a corresponding horizontal polarized transmit signal and a corresponding horizontal polarized receive signal at different frequencies.

7. The method of claim 6, wherein:

the vertical polarization transmit waveguide is configured to receive the vertical polarized transmit signal having a frequency between about 81 GHz and about 86 GHz, the vertical polarization receive waveguide is configured to receive the vertical polarized receive signal having a frequency between about 71 GHz and about 76 GHz, the horizontal polarization transmit waveguide is configured to receive the horizontal polarized transmit signal having a frequency between about 81 GHz and about 86 GHz, and the horizontal polarization receive waveguide is configured to receive the horizontal polarized receive signal having a frequency between about 71 GHz and about 76 GHz.

8. The method of claim 6, further comprising:

receiving the vertical polarized signal through the vertical polarization diplexer to/from a vertical polarization radio having a vertical polarization transmit output in communication with the vertical polarization transmit port of the vertical polarization diplexer and a vertical polarization receive input in communication with the vertical polarization receive port of the vertical polarization diplexer; and receiving the horizontal polarized signal through the horizontal polarization diplexer to/from a horizontal polarization radio having a horizontal polarization transmit output in communication with the horizontal polarization transmit port of the horizontal polarization diplexer and a horizontal polarization receive input in communication with the horizontal polarization receive port of the horizontal polarization diplexer.

9. The method of claim 8, further comprising:

receiving the vertical polarized transmit signal through a vertical polarization powered amplifier connected to the vertical polarization transmit output of the vertical polarization radio and the vertical polarization transmit port of the vertical polarization diplexer;

receiving the vertical polarized receive signal through a vertical polarization low noise amplifier connected to the vertical polarization receive input of the vertical polarization radio and the vertical polarization receive port of the vertical polarization diplexer;

receiving the horizontal polarized transmit signal through a horizontal polarization powered amplifier connected to the horizontal polarization transmit output of the horizontal polarization radio and the horizontal polarization transmit port of the horizontal polarization diplexer; and receiving the horizontal polarized receive signal through a horizontal polarization low noise amplifier connected to the horizontal polarization receive input of the horizontal polarization radio and the horizontal polarization receive port of the horizontal polarization diplexer.

10. A system comprising:

an ortho-mode transducer having a vertical polarization port, a horizontal polarization port, and a common port, the common port in communication with the vertical polarization port and the horizontal polarization port and configured to communicate with an antenna;

a vertical polarization diplexer having a vertical polarization transmit port, a vertical polarization receive port, and a vertical polarization common port, the vertical polarization common port in communication with the vertical polarization port of the ortho-mode transducer; and a horizontal polarization diplexer having a horizontal polarization transmit port, a horizontal polarization receive port, and a horizontal polarization common port, the horizontal polarization common port in communication with the horizontal polarization port of the ortho-mode transducer, wherein the ortho-mode transducer comprises:

a vertical polarization waveguide connected to the vertical polarization port;

a horizontal polarization waveguide connected to the horizontal polarization port, the horizontal polarization waveguide configured to define a first curved path and a second curved path oriented differently from the first curved path, the horizontal polarization waveguide defining a bifurcation into first and second bifurcated waveguides; and a common waveguide connected to the common port, the vertical polarization waveguide, and the first and second bifurcated waveguides of the horizontal polarization waveguide, the common waveguide comprising a septum polarizer configured to split or combine between:

a circular polarized signal received through the common port; and a vertical polarized signal received through the vertical polarization port and a horizontal polarized signal received through the horizontal polarization port.

11. The system of claim 10, wherein the first curved path of the horizontal polarization waveguide is disposed in a first plane and the second curved path of the horizontal polarization waveguide is disposed in a second plane substantially perpendicular to the first plane.

12. The system of claim 11, wherein each bifurcated waveguide defines a third curved path disposed in a third plane parallel to the second plane and a fourth curved path disposed in a fourth plane parallel to the first plane.

13. The system of claim 10, wherein the common waveguide defines a bifurcation junction having a square cross-sectional shape, the bifurcation junction connected to the first and second bifurcated waveguides of the horizontal polarization waveguide.

14. The system of claim 10, wherein the wherein the common port of the ortho-mode transducer defines a circular cross-sectional shape, and the vertical polarization port and the horizontal polarization port each define a rectangular cross-sectional shape.

15. The system of claim 10, wherein:

the vertical polarization diplexer comprises:

a vertical polarization transmit waveguide connected to the vertical polarization transmit port and the vertical polarization common port;

a vertical polarization receive waveguide connected to the vertical polarization receive port and the vertical polarization common port; and a vertical polarization common waveguide connected to the vertical polarization common port and the vertical polarization port of the ortho-mode transducer, wherein the vertical polarization transmit waveguide, the vertical polarization receive waveguide, and the vertical polarization common waveguide each define a rectangular cross-sectional shape, and wherein the vertical polarization transmit waveguide and the vertical polarization receive waveguide are configured to receive a corresponding vertical polarized transmit signal and a corresponding vertical polarized receive signal at different frequencies; and the horizontal polarization diplexer comprises:

a horizontal polarization transmit waveguide connected to the horizontal polarization transmit port and the horizontal polarization common port;

a horizontal polarization receive waveguide connected to the horizontal polarization receive port and the horizontal polarization common port; and a horizontal polarization common waveguide connected to the horizontal polarization common port and the horizontal polarization port of the ortho-mode transducer, wherein the horizontal polarization transmit waveguide, the horizontal polarization receive waveguide, and the horizontal polarization common waveguide each define a rectangular cross-sectional shape, and wherein the horizontal polarization transmit waveguide and the horizontal polarization receive waveguide are configured to receive a corresponding horizontal polarized transmit signal and a corresponding horizontal polarized receive signal at different frequencies.

16. The system of claim 15, wherein:

the vertical polarization transmit waveguide is configured to receive the vertical polarized transmit signal having a frequency between about 81 GHz and about 86 GHz, the vertical polarization receive waveguide is configured to receive the vertical polarized receive signal having a frequency between about 71 GHz and about 76 GHz, the horizontal polarization transmit waveguide is configured to receive the horizontal polarized transmit signal having a frequency between about 81 GHz and about 86 GHz, and the horizontal polarization receive waveguide is configured to receive the horizontal polarized receive signal having a frequency between about 71 GHz and about 76 GHz.

17. The system of claim 10, further comprising:

a vertical polarization radio having a vertical polarization transmit output in communication with the vertical polarization transmit port of the vertical polarization diplexer and a vertical polarization receive input in communication with the vertical polarization receive port of the vertical polarization diplexer; and a horizontal polarization radio having a horizontal polarization transmit output in communication with the horizontal polarization transmit port of the horizontal polarization diplexer and a horizontal polarization receive input in communication with the horizontal polarization receive port of the horizontal polarization diplexer.

18. The system of claim 10, further comprising:

a vertical polarization powered amplifier (PA) connected to the vertical polarization transmit output of the vertical polarization radio and the vertical polarization transmit port of the vertical polarization diplexer;

a vertical polarization low noise amplifier (LNA) connected to the vertical polarization receive input of the vertical polarization radio and the vertical polarization receive port of the vertical polarization diplexer;

a horizontal polarization powered amplifier connected to the horizontal polarization transmit output of the horizontal polarization radio and the horizontal polarization transmit port of the horizontal polarization diplexer; and a horizontal polarization low noise amplifier connected to the horizontal polarization receive input of the horizontal polarization radio and the horizontal polarization receive port of the horizontal polarization diplexer.

* * * * *